United States Patent [19]

Nauta et al.

[11] Patent Number: 4,758,406

[45] Date of Patent: Jul. 19, 1988

[54] MOLYBDENUM ADDITION AGENT AND PROCESS FOR ITS PRODUCTION

[75] Inventors: Harry H. K. Nauta, Brielle, Netherlands; Thomas A. R. Laurin, Västerås, Sweden

[73] Assignee: Amax Inc., New York, N.Y.

[21] Appl. No.: 125,504

[22] Filed: Nov. 25, 1987

[51] Int. Cl.[4] ..... C22C 33/00

[52] U.S. Cl. ..... 420/129; 75/0.5 B; 75/0.5 BB; 75/53; 420/123

[58] Field of Search ..... 75/0.5 R, 0.5 BB, 53; 420/123, 129

[56] References Cited

U.S. PATENT DOCUMENTS

| | | | |
|---|---|---|---|
| 3,053,614 | 9/1962 | Foos | 75/0.5 BB |
| 4,011,073 | 3/1977 | Powers | 75/0.5 BB |
| 4,595,412 | 6/1986 | Brunelli | 75/0.5 BB |

*Primary Examiner*—Peter D. Rosenberg

*Attorney, Agent, or Firm*—Michael A. Ciomek; Eugene J. Kalil

[57] ABSTRACT

Molybdenite is roasted under controlled conditions to provide a polymolybdenum oxide composition having an oxygen content in excess of the stoichiometric oxygen content for $MoO_2$ and less than that for $MoO_3$, such that the composition contains $MoO_3$ equivalent in excess of 5% and ranging up to 15% by weight, preferably, from about 10% to 15% by weight. The polymolybdenum oxide composition can be used to introduce molybdenum into baths of molten steel and the like with high recovery of the molybdenum content in the bath and with quiet addition characteristics as compared to the use of $MoO_3$ per se. Preferably, a Herreshoff type roaster is used and the production rate of the furnace producing the new product is substantially increased, with an exit gas richer in $SO_2$, as compared to use of the same roaster in roasting molybdenite to form $MoO_3$ per se.

7 Claims, 2 Drawing Sheets

MOLYBDENUM ADDITION AGENT AND PROCESS FOR ITS PRODUCTION

The invention is directed to a special oxidic molybdenum addition agent which may be added to molten steel baths and the like characterized by substantially reduced vaporization and loss of molybdenum; and to a process for producing the special agent.

BACKGROUND OF THE INVENTION AND THE PRIOR ART

For the purpose of alloying molybdenum to steel, molybdic trioxide is the common molybdic oxide used. The molybdic trioxide is generally added together with the scrap charge in electric arc-furnaces. Molybdic trioxide may be formed and packaged as powder in drums, powder in cans or as briquettes.

Molybdic trioxide is volatile at steelmaking temperatures. Standard handbooks give the melting point of molybdic trioxide as 782°±5° C. (1440° F.) and state that it sublimes. When molybdenum trioxide is added to molten steel baths, high losses due to the formation of molybdic trioxide gas are encountered. When used as an addition to steel converters, the gas forms as a hot jet and is accompanied by the production of intense smoke which penetrates the steel works. The hot jet of smoke can damage equipment outside the converter and, unless special precautions are taken, damage the converter as well. The sudden formation of gas produces a sound similar to the detonation of a small bomb.

Because of the limitations presented by molybdic trioxide, ferromolybdenum, which is considerably more expensive, is normally used as the agent for adding molybdenum to a molten steel bath. There is great need for an agent which would operate with less pyrotechnics and which is less inexpensive than ferromolybdenum.

It is known to produce molybdenum trioxide commercially by roasting molybdenite (i.e., $MoS_2$, the principal ore of molybdenum). Roasting is usually accomplished in a multi-hearth furnace of the Herreshoff type. U.S. Pat. No. 4,034,969, which is incorporated herein by reference, describes such a furnace and a means of controlling temperature therein which employs water jets as well as control of air flow to the various hearths. As pointed out in the patent, the use of increased air flow to control temperature on a particular hearth is not completely effective since air admitted to a hearth tends to flow upwards as well as across the hearth.

Increase in total air flow to the furnace results in dilution of the $SO_2$ content of the exit gas which is undesirable for a number of reasons. For example, where $SO_2$ is recovered in a sulfuric acid plant, this operation is more efficient when a rich gas is employed. Desirably, the $SO_2$ content of the exit gas should be 2% or 3% or more. Increase in total gas flow raised many other costs in terms of equipment size, larger dust collection facilities, etc. It is accordingly desirable to operate the roaster with the lowest gas flow consistent with temperature control and completion of roasting.

SUMMARY OF THE INVENTION

In accordance with the invention, molybdenite is roasted in a multiple-hearth furnace to form a special substantially non-volatile polymolybdenum oxide composition consisting essentially of 80–90% of a product defined by the shaded area "A" of the phase diagram of FIG. 4 corresponding to $MoO_2$ equivalent containing by weight in excess of 5% $MoO_3$ equivalent and ranging up to about 15%, preferably about 10% to 15% by weight and a sulfur content of less than 2%. This polymolybdenum oxide product can be added to a molten steel bath without difficulty and with high recovery of the contained molybdenum. Because of the nature of the polymolybdenum oxide composition, the product liquifies easily at steel making temperatures and does not gasify as does $MoO_3$ per se which sublimes at relatively low temperatures.

Moreover, during the roasting operation to produce the product, air requirements are lowered substantially as compared to the air requirements to produce $MoO_3$ per se. In addition, richer $SO_2$-containing gas suitable for conversion to sulfuric acid is obtained.

DETAILED DESCRIPTION OF THE INVENTION

Figure 1:
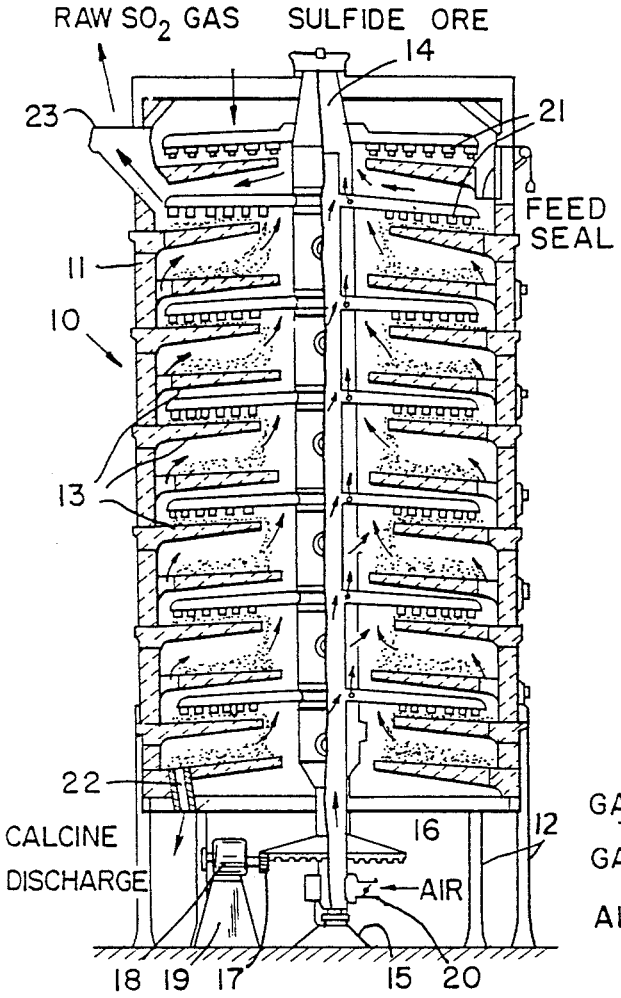
FIG. 1, depicts the cross-section of a Herreshoff type roaster adapted for roasting molybdenite.

The process of the invention will be described in conjunction with the drawing in which FIG. 1 depicts a conventional Nichols-Herreshoff furnace for converting molybdenite to $MoO_3$. The furnace 10 illustrated is comprised of an outer shell 11 of suitable heat resistant material supported on legs 12, the furnace having a plurality of multilevel hearths 13, each having a centrally located axial opening through which a hollow shaft 14 passes and is rotatably supported by a base 15. The hollow shaft is provided with a bevelled gear 16 which is driven by drive gear 17 mounted on motor 18 which is supported on pillow block 19. The hollow shaft is provided with an air feed opening 20 through which air is fed, the hollow shaft having air exit openings at each hearth level through which the air flows into the rabble arms of each hearth level while circulating from the bottom to the top furnace. Gas is fed by means not shown, the gas conventionally circulating as shown by the arrows.

However, certain of the hearths may have outlet flues to promote cross flow. The air flow serves a two-fold purpose: it helps to keep the furnace from overheating; and, secondly, it provides the necessary oxidizing atmosphere for roasting the ore. Each hearth has associated with it rabble arms 21 which project radially outward from the shaft. Thus, as the shaft rotates, the sulfide concentrate is fed from the top of the furnace and falls from hearth to hearth as the concentrate is being rabbled. The rabbling is such that, on one hearth, it is rabbled outwardly and deposits on the next hearth below, the rabble arm on the next hearth being adapted to move the concentrate radially inwardly until it deposits on the next succeeding hearth below it, and so on.

As the concentrate courses its way downward, it is converted to an oxide and is discharged as calcine at the bottom at 22. As the $SO_2$ forms, it leaves the flue gas at the top at 23.

Figure 2:
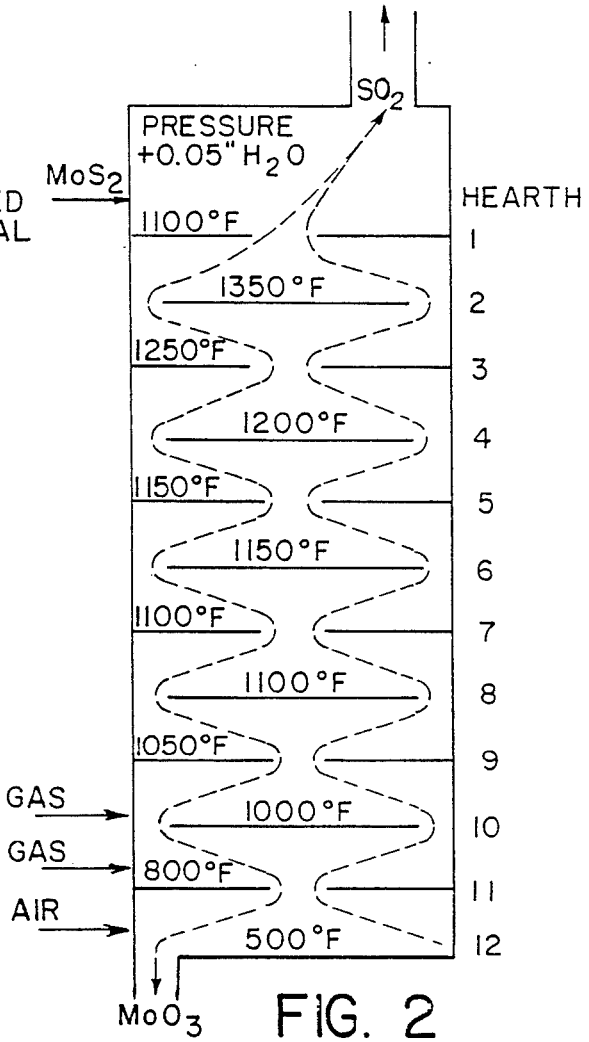
FIG. 2, is a cross-section of the roaster depicted in FIG. 1 with materials flow and hearth temperatures shown.

Under ordinary roasting conditions, the temperature profile may reach a steady state along the line shown diagrammatically in FIG. 2. As will be noted, the temperature appears to be highest at hearths No. 2 to No. 4, the temperature falling within the range of about 1200° F. (650° C.) to 1350° F. (730° C.). The temperature on these hearths is frequently above control temperature, while the temperature at the lower hearths is generally controlled under conventional practice. It is desirable to maintain the temperature at the top three or four hearths over a lower range, such as 1100° F. (595° C.) or 1200° F. (650° C.), in order to avoid melting or fusing with other ingredients. The necessary temperature control can be achieved by cooling water sprays as described in U.S. Pat. No. 4,034,969.

Figure 3:
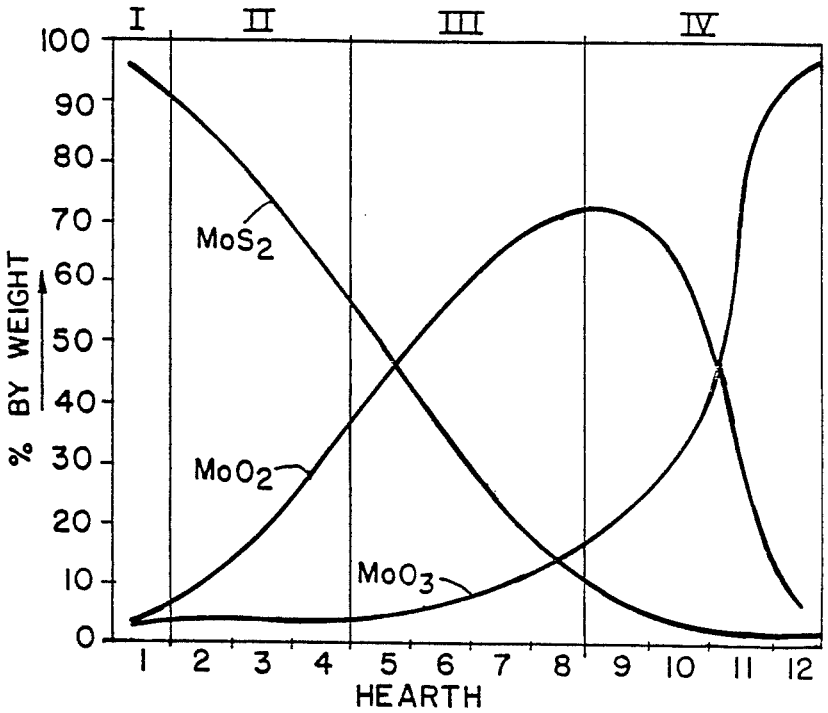
FIG. 3, is a graph depicting sulfur elimination and conversion to $MoO_3$ as carried out conventionally.
Figure 5:
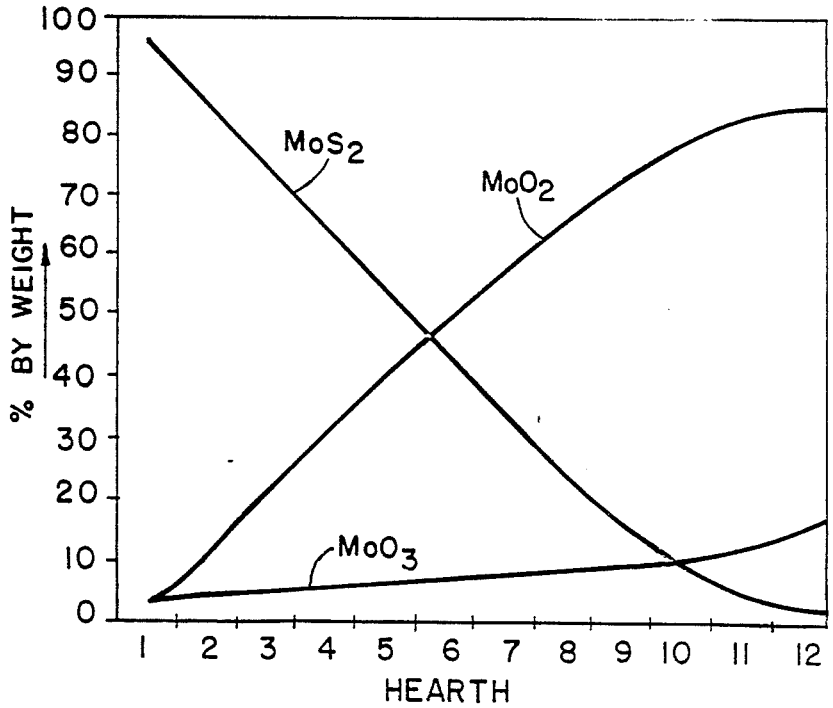
FIG. 5, is a graph depicting sulfur elimination and conversion into the special polymolybdenum oxide composition in accordance with the invention.

FIG. 3 depicts sulfur elimination and molybdenum conversion as conventionally carried out in the roaster depicted in FIGS. 1 and 2 in which molybdenite is roasted to $MoO_3$ under steady state conditions. In particular, the hearth numbers in FIG. 3 correspond to those of FIGS. 1 and 2.

The roaster is operated using about 10.2 Nm air per pound Mo. The dividing zones indicated on FIG. 3 represent areas in the roaster where the indicated conversion reactions appear to predominate Inspection of FIG. 3 shows that the reactions which predominate in each roaster zone are:

Zone I: The concentrate is essentially dried and de-oiled to remove flotation oil on hearth No. 1; the $MoS_2$ to $MoO_2$ reaction is also initiated.

Zone II: The conversion of $MoS_2$ to $MoO_2$ appears to be the predominant reaction on hearths Nos. 2 to 4; the $MoO_2$ to $MoO_3$ reaction appears to begin but then stops caused by the reaction: $6MoO_3+MoS_2 \rightarrow 7MoO_2+2SO_2$;

Zone III: The conversion of $MoS_2$ to $MoO_2$ continues on hearths No. 5 to No. 9 and appears to be the predominant reaction; the $MoO_2$ to $MoO_3$ reaction appears to be minor, caused by the reaction: $6MoO_3+MoS_2 \rightarrow 7MoO_2+2SO_2$;

Zone IV: The conversion of $MoO_2$ to $MoO_3$ appears to be the predominant reaction on hearths No. 10 to No. 12.

As noted, the predominant reaction in Zones II and III, coverning hearths 2–9 is the conversion of $MoS_2$ to $MoO_2$ with minor conversion to $MoO_3$. When the roaster is used to produce $MoO_3$, the reaction $MoO_2 \rightarrow MoO_3$ is the predominant reaction in Zone IV.

The studies we have conducted of the roaster show that in zones where the reaction $MoS_2 \rightarrow MoO_2$ predominates, less excess air is needed than in Zone IV, where $MoO_3$ is produced. The studies also indicated that the $MoS_2 \rightarrow MoO_2$ reaction rate is more dependent upon the number of hearths over which the material passes than upon the available air.

In operating to produce $MoO_3$, the high air requirement in Zone IV upsets air flow in higher zones and causes undesired but unavoidable effects, particularly, in reducing the $SO_2$ strength in the exit gas. Due to the cooling effect of the excess air, fuel must be burned in the lower hearths, resulting in even further dilution of the furnace gas with combustion products.

As shown in FIG. 3, sulfur elimination is almost complete on hearth No. 9 at the border between Zones III and IV. Studies underlying the invention thus show that the hearth-type roaster is most efficient in conducting the $MoS_2 \rightarrow MoO_2$ reaction.

Figure 4:
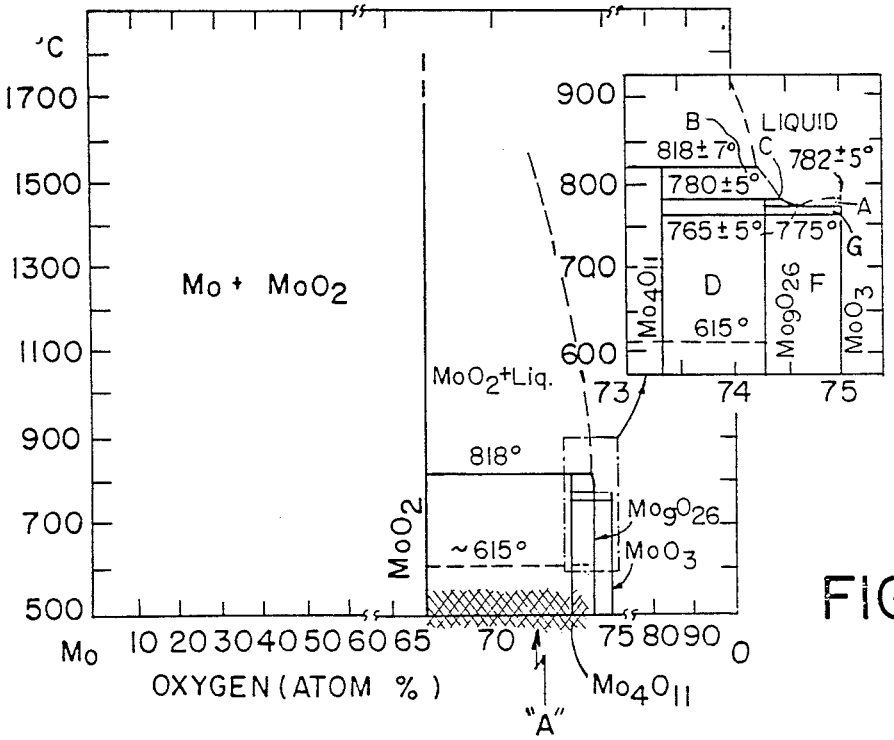
FIG. 4, is the Mo-O phase diagram.

The first consideration in accordance with the invention is to operate the hearth-type roaster with about 200% excess air throughout to produce a polymolybdenum oxide composition consisting essentially of about 80–90% of a product falling within the shaded area "A" of the phase diagram of FIG. 4, the product containing 10–15% by weight equivalent $MoO_3$ and a sulfur content of less than 2%. The product normally contains by weight about 0.1% to about 1.3% sulfur, generally less than about 0.7%. Operation of the roaster to produce the polymolybdenum oxide product yields a rich exit gas containing about 3.5% $SO_2$, e.g., generally about 2% to about 5% $SO_2$ by volume; which reduces greatly the volume of gas which must be treated in the acid plant. Savings in dust collection and heating fuel also result.

The surprising discovery found from the study of the roasting reaction in the multiple-hearth furnace is that the inventive product may be added to a bath of molten steel without the production of a gas jet, smoke or explosive noise as occurs when $MoO_3$ per se is used as the addition agent.

As illustrative of the invention, the following example is given.

A multi-hearth furnace as depicted in FIGS. 1 and 2 was used to roast molybdenite with about 200% excess air. At a feed rate of about 2000 pounds of Mo per hour, a product was obtained which contained 66% Mo, about 0.5% sulfur and about 7% gangue. The product had a particle size of about 90% minus 100 mesh. The product was packaged in 200 kg drums and was used as an addition agent in a molten bath of 316 Ti stainless steel.

Mo-addition was made in the 75 t AOD-converter (i.e., argon/oxygen converter) just after filling the AOD with steel from the arc-furnace. First, one 200 kg drum was added. Argonstirring followed for a few minutes. The temperature was measured and steel analysis taken. Then three 200 kg drums were added followed by the same procedure.

The drums of the polymolybdenum oxide entered the bath smoothly and efficiently. Steel workers and engineers observing the operation were impressed by the calmness of the reaction between the product and the molten stainless steel. When normal $MoO_3$ is added there is always a great deal of intense smoke formed and, in addition, a jet of hot gas is produced in the converter. On a few occasions such gas jets have damaged steel works equipment. It is not uncommon for the $MoO_3$ addition to produce noise that sounds like the detonation of a small bomb.

The test was carried out on a 316 Ti stainless steel with final Mo-content at just above 2%. The yield of Mo for the converter addition was above 96%.

It is to be appreciated that the furnace temperature profile given in FIG. 2 represents that for steady state production of molybdenum trioxide per se. For purposes of this invention the following table provides a preferred temperature profile:

| Hearth No. | Temperature °C. |
|---|---|
| 1 | 300–700 |
| 2 | 500–700 |
| 3 | 600 |
| 4 | 600 |

-continued

| Hearth No. | Temperature °C. |
|---|---|
| 5 | 600 |
| 6 | 600 |
| 7 | 600 |
| 8 | 600 |
| 9 | 600 |
| 10 | 600 |
| 11 | 600 |
| 12 | 600 |

Temperature variation from the foregoing profile preferably does not exceed +100° C.

The multiple hearth roaster comprises at least a series of hearths, preferably at least seven hearths, starting with a first and second hearth and a plurality of hearths thereafter, the said plurality of hearths being controlled at a temperature of about 500° C. to 700° C., preferably 500° C. to 600° C.

It is to be understood that the molybdenite concentrate preferably is de-oiled before roasting to reduce the content of flotation oils to a level below about 2–3%. De-oiling reduces heat generation on the top hearths due to oil combustion and aids in controlling temperatures. It is also to be appreciated that use of either air or water for cooling increases the gas burden in the furnace and reduces $SO_2$ concentration in the gas streams.

Desirably, hearth temperatures during roasting to provide the new polymolybdenum oxide product should not exceed about 700° C., e.g., should fall in the range of about 500° to 700° C., preferably about 500°–600° C. Residence time at temperature should be about 5 to 12 hours.

In addition to producing a product having greatly improved addition characteristics when used to introduce molybdenum into molten steel, the process of the invention offers other substantial advantages. Thus, considerably less air is required, and less fuel is required to maintain temperature in the normally cooler lower hearths. All of these factors reduce furnace atmosphere volume and provide an exit gas richer in $SO_2$ which improves the operation of the sulfuric acid plant. Further, feed rate to the furnace can be increased substantially. About 20% to 60% more molybdenite can be treated per area of hearth surface as compared to operation of the same furnace employed to produce $MoO_3$ per se.

Further, because of the higher molybdenum to oxygen ratio of the polymolybdenum oxide product, less reducing agents are consumed from the molten steel. Normally, the molybdenum oxide will be reduced by an element present in the steel melt which has a higher affinity to oxygen than molybdenum, i.e., all metals in the melt with the exception of nickel. The most active of the reducing agents are carbon and silicon. At low carbon and silicon contents in the melt, the molybdenum oxide will be reduced by chromium, manganese and even iron. The oxides formed will report to the slag and extra elements have to be added later to the melt to recover the losses.

The oxygen content of the polymolybdenum oxide composition produced in accordance with the invention lies between the stoichiometric oxygen content of $MoO_2$ and $MoO_3$, the stoichiometric oxygen content of these compounds being as follows:

| Compound | Mole Weight | % wt Oxygen | Atomic % Oxygen |
|---|---|---|---|
| $MoO_2$ | 128 | 25 | 67 |
| $MoO_3$ | 144 | 33.3 | 75 |

The oxygen content of the polymolybdenum oxide composition, excluding the gangue material, ranges from about 26% to 32.5% by weight, and preferably about 27% to 31.5% by weight, the composition falling within the shaded area "A" depicted in FIG. 4. The novel composition is achieved when the temperature during the terminal stages is maintained at about 500° C. to 700° C. and, more preferably, between 500° C. to 600° C. The sulfur content is reduced to less than about 2% by weight and generally to less than about 0.7%.

As will be noted from FIG. 4, molybdenum oxide is capable of forming various polymolybdenum oxide compounds, among which are included $Mo_4O_{11}$ and $Mo_9O_{26}$, the former containing 31.4% by weight oxygen and the latter about 32.5% by weight of oxygen.

While the exact nature of the polymolybdenum oxide composition is not certain, it appears to correspond to predominantly $MoO_2$ equivalent and contains by weight in excess of 5% to about 15% $MoO_3$ equivalent, preferably about 10% to 15%.

The composition as an addition agent to molten metal, e.g., molten steel, is easily consumed by the host metal with substantially reduced volatility, if any.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A molybdenum-containing addition agent for incorporating molybdenum in a molten metal bath maintained at a temperature of at least about 1500° C., said addition agent consisting essentially of polymolybdenum oxide composition derived from the roasting of $MoS_2$ at an elevated temperature sufficient to provide a roasted product in which the oxygen content of said composition exceeds the stoichiometric oxygen content of $MoO_2$ and is less than the stoichiometric oxygen content of $MoO_3$, said oxygen content, excluding gangue material, ranging from about 26% to 32.5% by weight, with the sulfur content less than about 2%, by weight, said polymolybdenum oxide composition having an equivalent $MoO_3$ content in excess of 5% and ranging up to about 15% by weight.

2. The molybdenum-containing addition agent of claim 1, wherein said polymolybdenum oxide composition is derived from roasting $MoS_2$ at a temperature in the range of about 500° C. to 700° C., wherein the oxygen content thereof ranges from about 27% to 31.5% and the sulfur content is less than about 0.7%, and wherein the equivalent $MoO_3$ content ranges from about 10% to 15% by weight.

3. A process for introducing molybdenum into a molten metal bath having a temperature of at least about 1500° C. which comprises:

introducing said molybdenum as an addition agent in the form of a polymolybdenum oxide composition derived from the roasting of $MoS_2$ at an elevated temperature sufficient to provide a roasted product in which the oxygen content of said composition exceeds the stoichiometric oxygen content of $MoO_2$ and is less than the stoichiometric oxygen content of $MoO_3$, said oxygen content, excluding gangue material, ranging from about 26% to 32.5% by weight, with the sulfur content less than about 2%, by weight, said polymolybdenum oxide composition having an equivalent $MoO_3$ content in excess of 5% and ranging up to about 15% by weight, said polymolybdenum oxide composition entering said molten metal bath efficiently and with substantially reduced volatization.

4. The process as defined in claim 3, wherein said polymolybdenum oxide composition introduced in said molten bath is derived from roasting $MoS_2$ at a temperature in the range of about 500° C. to 700° C., wherein the oxygen content thereof ranges from about 27% to 31.5% and the sulfur content is less than about 0.7%, and wherein the equivalent $MoO_3$ content ranges from about 10% to 15% by weight.

5. The process of claim 3, wherein said molybdenum-containing addition agent is added to said molten metal bath in a form selected from the group consisting of powder, pellets or briquettes.

6. A process for producing a molybdenum-containing addition agent for use in molten metal baths which comprises:

roasting $MoS_2$ concentrate in a multiple hearth roaster comprising a first and second hearth and a plurality of hearths thereafter in which the temperature of each of said plurality of hearths is controlled at a temperature of about 500° C. to 700° C., controlling the air supply for each hearth at a rate less than that required to convert the molybdenum sulfide concentrate completely to $MoO_3$, and thereby produce a polymolybdenum oxide composition at a rate of about 20% to 60% higher per area of hearth surface as compared to the production of $MoO_3$ per se, said polymolybdenum oxide composition characterized in that the oxygen content thereof exceeds the stoichiometric oxygen content of $MoO_2$ and is less than the stoichiometric oxygen content of $MoO_3$, said oxygen content, excluding gangue material, ranging from about 26% to 32.5% by weight with the sulfur content less than about 2% by weight, the $MoO_3$ equivalent content thereof being in excess of about 5% and ranging up to about 15% by weight.

7. The process of claim 6, wherein said multiple hearth furnace is a Herreshoff type roaster and wherein said roasting is carried out through a series of at least seven hearths, the polymolybdenum oxide composition produced thereby containing about 27% to 31.5% with the sulfur content less than about 0.7%, the $MoO_3$ equivalent content thereof ranging from about 10% to 15% by weight.

* * * * *

US004758406B1

REEXAMINATION CERTIFICATE (2079th)

United States Patent [19]

Nauta et al.

[11] B1 4,758,406

[45] Certificate Issued Aug. 31, 1993

[54] MOLYBDENUM ADDITION AGENT AND PROCESS FOR ITS PRODUCTION

[75] Inventors: Harry H. K. Nauta, Brielle, Netherlands; Thomas A. R. Laurin, Västerås, Sweden

[73] Assignee: Amax Inc., New York, N.Y.

Reexamination Request:
No. 90/002,265, Feb. 1, 1991

Reexamination Certificate for:

| | |
|---|---|
| Patent No.: | 4,758,406 |
| Issued: | Jul. 19, 1988 |
| Appl. No.: | 125,504 |
| Filed: | Nov. 25, 1987 |

[51] Int. Cl.[5] ..... C22C 33/00
[52] U.S. Cl. ..... 420/129; 423/606
[58] Field of Search ..... 420/129, 219

[56] References Cited

U.S. PATENT DOCUMENTS

| | | | |
|---|---|---|---|
| 3,053,614 | 9/1962 | Foos | 423/511 |
| 3,361,000 | 8/1967 | Cloppet . | |
| 4,011,073 | 3/1977 | Powers | 75/232 |
| 4,595,412 | 6/1986 | Brunelli | 75/363 |

OTHER PUBLICATIONS

Huggins et al "Fundamental Investigations of Molybdenite Hearth Roasting" Presented at the Molybdenum Symposium of the Sixteenth Annual Conference of Metallurgists of the Metallurgical Society of CIM, Vancouver, B.C. Aug. 24, 1977.

Lastovitskaya et al "Roasting Molybdenite Concentrate in a Multihearth Roaster" Tsvetnyemetally, 11(7) (1970) 52.

*Primary Examiner*—Peter D. Rosenberg

[57] ABSTRACT

Molybdenite is roasted under controlled conditions to provide a polymolybdenum oxide composition having an oxygen content in excess of the stoichiometric oxygen content for $MoO_2$ and less than that for $MoO_3$, such that the composition contains $MoO_3$ equivalent in excess of 5% and ranging up to 15% by weight, preferably, from about 10% to 15% by weight. The polymolybdenum oxide composition can be used to introduce molybdenum into baths of molten steel and the like with high recovery of the molybdenum content in the bath and with quiet addition characteristics as compared to the use of $MoO_3$ per se. Preferably, a Herreshoff type roaster is used and the production rate of the furnace producing the new product is substantially increased, with an exit gas richer in $SO_2$, as compared to user of the same roaster in roasting molybdenite to form $MoO_3$ per se.

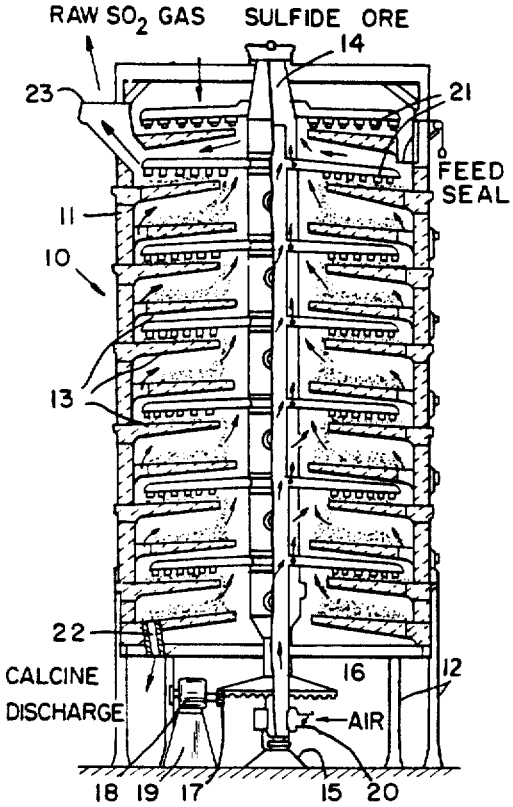

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2 are cancelled.

Claims 3, 4, 6, 7 are determined to be patentable as amended.

Claim 5, dependent on an amended claim, is determined to be patentable.

New claims 8-10 are added and determined to be patentable.

3. A process for introducing molybdenum into a molten metal bath having a temperature of at least about 1500° C. which comprises:

introducing said molybdenum as an addition agent in the form of a polymolybdenum oxide composition derived from the roasting of $MoS_2$ at an elevated temperature sufficient to provide a roasted product in which the oxygen content of said composition exceeds the stoichiometric oxygen content of $MoO_2$ and is less than the stoichiometric oxygen content of $MoO_3$, said oxygen content, excluding gangue material, ranging from about 26% to 32.5% by weight, with the sulfur content less than about 2%, by weight, said polymolybdenum oxide composition *of said addition agent* having an equivalent $MoO_3$ content in excess of 5% and [ranging up to about] *not exceeding* 15% by weight, said [polymolybdenum oxide composition] *addition agent* entering said molten metal bath efficiently and with substantially reduced volatization.

4. The process as defined in claim 3, wherein said [polymolybdenum oxide composition] *addition agent* introduced in said molten bath is derived from roasting $MoS_2$ at a temperature in the range of about 500° C. to 700° C., wherein the oxygen content thereof ranges from about 27% to 31.5% and the sulfur content is less than about 0.7%, and wherein the equivalent $MoO_3$ content [ranges from] *is at least* about 10% [to] *and does not exceed* 15% by weight.

6. A process for producing a molybdenum-containing addition agent for use in molten metal baths which comprises:

roasting $MoS_2$ concentrate in a multiple hearth roaster comprising a first and second hearth and a plurality of hearths thereafter in which the temperature of each of said plurality of hearths is controlled at a temperature of about 500° C. to 700° C., controlling the air supply for each hearth at a rate less than that required to convert the molybdenum sulfide concentrate completely to $MoO_3$, and thereby produce *as a final product* a polymolybdenum oxide composition at a rate of about 20% to 60% higher per area of hearth surface as compared to the production of $MoO_3$ per se, said polymolybdenum oxide composition characterized in that the oxygen content thereof exceeds the stoichiometric oxygen content of $MoO_2$ and is less than the stoichiometric oxygen content of $MoO_3$, said oxygen content, excluding gangue material, ranging from about 26% to 32.5% by weight with the sulfur content less than about 2% by weight, the $MoO_3$ equivalent content thereof being in excess of about 5% and [ranging up to about] *and does not exceed* 15% by weight.

7. The process of claim 6, wherein said multiple hearth furnace is a Herreshoff type roaster and wherein said roasting is carried out through a series of at least seven hearths, the polymolybdenum oxide composition produced thereby containing about 27% to 31.5% with the sulfur content less than about 0.7%, the $MoO_3$ equivalent content thereof ranging from about 10% to *not exceeding* 15% by weight.

*8. As an article of manufacture, a molybdenum-containing addition agent for incorporating molybdenum in a molten metal bath maintained at a temperature of at least about 1500° C., said addition agent consisting essentially of a polymolybdenum oxide produced by:*

*roasting $MoS_2$ concentrate in a multiple hearth roaster comprising a first and second hearth and a plurality of hearths thereafter in which the temperature of each of said plurality of hearths is controlled at a temperature of about 500° C. to 700° C.,*

*controlling the air supply for each hearth at a rate less than that required to convert the molybdenum sulfide concentrate completely to $MoO_3$,*

*and thereby produce as a final product a polymolybdenum oxide composition,*

*said polymolybdenum oxide composition characterized in that the oxygen content thereof exceeds the stoichiometric oxygen content of $MoO_2$ and is less than the stoichiometric oxygen content of $MoO_3$,*

*said oxygen content, excluding gangue material, ranging from about 26% to 32.5% by weight with the sulfur content less than about 2% by weight, the $MoO_3$ equivalent content thereof is in excess of about 5% and does not exceed 15% by weight.*

*9. The article of manufacture as set forth in claim 8,*

*wherein the oxygen content of the polymolybdenum oxide produced ranges from about 27% to 31.5% and the sulfur content is less than 0.7%,*

*and wherein the equivalent $MoO_3$ content is at least about 10% and does not exceed 15% by weight.*

*10. The article of manufacture as set forth in claim 8,*

*wherein the polymolybdenum oxide product is in a form selected from the group consisting of powder, pellets and briquettes.*

* * * * *